US009431206B2

(12) United States Patent
Tsujino et al.

(10) Patent No.: US 9,431,206 B2
(45) Date of Patent: Aug. 30, 2016

(54) X-RAY GENERATION TUBE, X-RAY GENERATION DEVICE INCLUDING THE X-RAY GENERATION TUBE, AND X-RAY IMAGING SYSTEM

(71) Applicant: CANON KABUSHIKI KAISHA, Tokyo (JP)

(72) Inventors: Kazuya Tsujino, Tokyo (JP); Kazuyuki Ueda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 155 days.

(21) Appl. No.: 14/193,601

(22) Filed: Feb. 28, 2014

(65) Prior Publication Data

US 2014/0254755 A1 Sep. 11, 2014

(30) Foreign Application Priority Data

Mar. 6, 2013 (JP) ..... 2013-043842
Feb. 19, 2014 (JP) ..... 2014-029252

(51) Int. Cl.
*H01J 35/04* (2006.01)
*H01J 35/14* (2006.01)
*G21K 1/02* (2006.01)

(52) U.S. Cl.
CPC ..... *H01J 35/045* (2013.01); *H01J 35/14* (2013.01); *G21K 1/02* (2013.01)

(58) Field of Classification Search
CPC ..... H01J 35/045; H01J 35/14; H01J 35/04; G21K 1/02
See application file for complete search history.

(56) References Cited

U.S. PATENT DOCUMENTS 4,670,894 A * 6/1987 Birnbach ..... G21K 1/02 378/122
7,068,749 B2 6/2006 Kollegal et al.
8,258,488 B2 * 9/2012 Platzgummer ..... B82Y 10/00 250/492.1
8,472,585 B2 6/2013 Ogura et al.
8,576,988 B2 11/2013 Lewalter et al.
8,750,457 B2 6/2014 Ogura et al.
2003/0185344 A1 * 10/2003 Ukita ..... H01J 35/08 378/143
2004/0234023 A1 11/2004 Kollegal et al.
2006/0104418 A1 5/2006 Dunham et al.

(Continued)

FOREIGN PATENT DOCUMENTS

CN 1550215 A 12/2004
CN 102498540 A 6/2012

(Continued)

OTHER PUBLICATIONS

Office Action dated Feb. 1, 2016, in corresponding CN Application No. 201410079593.5 (10 pages including translation).

*Primary Examiner* — Wyatt Stoffa
(74) *Attorney, Agent, or Firm* — Fitzpatrick, Cella, Harper & Scinto

(57) ABSTRACT

Provided is a high-output X-ray generation tube in which thermal damage to a target is reduced. The X-ray generation tube includes a target, an electron source, and a grid electrode having multiple electron passage apertures disposed between the target and the electron source. A source-side electron beam on the electron source side with respect to the grid electrode has a current density distribution, and the grid electrode has an aperture ratio distribution so that a region of the source-side electron beam in which a current density is largest is aligned with a region of the grid electrode in which an aperture ratio is smallest.

25 Claims, 7 Drawing Sheets

(56) References Cited

U.S. PATENT DOCUMENTS

2007/0237300 A1* 10/2007 Kim ..... H01J 35/065 378/122
2010/0008470 A1* 1/2010 Hauttmann ..... H01J 35/06 378/135
2011/0038460 A1* 2/2011 Grasruck ..... H01J 35/045 378/138
2011/0142204 A1* 6/2011 Zou ..... H01J 35/065 378/138
2011/0305312 A1* 12/2011 Hu ..... H01J 35/065 378/4
2012/0027179 A1* 2/2012 Ogata ..... H01J 35/045 378/101
2012/0100307 A1* 4/2012 Aida ..... C23C 16/45525 427/569
2012/0121069 A1* 5/2012 Aoki ..... H01J 35/045 378/98.8
2012/0300901 A1 11/2012 Lewalter et al.
2012/0307978 A1* 12/2012 Yamazaki ..... H01J 35/06 378/121
2012/0314837 A1* 12/2012 Tsujii ..... H01J 35/08 378/62
2012/0318987 A1* 12/2012 Miyazaki ..... H01J 35/08 250/358.1
2013/0016810 A1* 1/2013 Tamura ..... H01J 35/12 378/62
2013/0016812 A1 1/2013 Yanagisawa et al.
2013/0129046 A1* 5/2013 Yamazaki ..... H01J 35/02 378/62
2013/0230143 A1 9/2013 Ueda et al.
2013/0235975 A1 9/2013 Tamura et al.
2014/0140480 A1 5/2014 Ogura et al.
2014/0140486 A1 5/2014 Yanagisawa et al.

FOREIGN PATENT DOCUMENTS

JP H4-3384 U 1/1992
JP 2000-285838 A 10/2000
JP 2011-081930 A 4/2011
WO 2011/105035 A2 9/2011

* cited by examiner

X-RAY GENERATION TUBE, X-RAY GENERATION DEVICE INCLUDING THE X-RAY GENERATION TUBE, AND X-RAY IMAGING SYSTEM

BACKGROUND OF THE INVENTION

1. Field of the Invention

The present invention relates to an improvement of output power of an X-ray generation tube, an X-ray generation device, and an X-ray imaging system.

2. Description of the Related Art

An X-ray generation tube is an X-ray source that is used for an X-ray generation device in an application of a medical diagnosis or a nondestructive inspection such as a foreign matter inspection. The X-ray generation tube includes an electron gun for emitting an electron beam, an anode for accelerating electrons, and a target for generating an X-ray by a collision of the electrons. The target is electrically connected to the anode.

It is known that, in order to obtain a predetermined analysis resolution, the X-ray generation device includes a grid electrode having an electrostatic lens action for a purpose of decreasing a focus diameter of the electron beam to be formed on the target.

Japanese Patent Application Laid-Open No. 2011-81930 describes an X-ray generation device including a lens electrode for focusing the electron beam, which is disposed between an electron emitting portion and the target.

On the other hand, when the X-ray generation tube outputs an X-ray, approximately 1% of kinetic energy of electrons included in the electron beam irradiating the target is used for the X-ray, and most of the input energy is converted into thermal energy, with the result that a temperature of the target rises.

The target of the X-ray generation tube is irradiated with the focused electron beam, and hence is apt to be thermally damaged at a region where current density distribution of the electron beam is largest.

Japanese Examined Utility Model Application Publication No. H04-3384 discloses a method of reducing thermal damage to the focusing center portion of the target by devising a cathode structure. Japanese Examined Utility Model Application Publication No. H04-3384 discloses the method in which a cathode filament is formed into a spiral shape, and an end of the filament is positioned in the center portion of the spiral filament, so as to decrease the temperature at the center portion of the electron beam, and to reduce the current density of the electron beam of emitted thermal electrons.

SUMMARY OF THE INVENTION

It is an object of the present invention to provide an X-ray generation tube capable of reducing thermal damage to the target and emitting an X-ray with high output intensity. Further, it is another object of the present invention to provide an X-ray generation device and an X-ray imaging system, in which a target has high life characteristics and output power is high.

According to one embodiment of the present invention, there is provided an X-ray generation tube, including: a target for generating an X-ray through irradiation with an electron beam; an electron source provided opposed to the target; and a grid electrode having multiple electron passage apertures, in which the grid electrode is disposed between the target and the electron source so that a part of a source-side electron beam emitted from the electron source passes through the multiple electron passage apertures and irradiates the target, in which the source-side electron beam has a current density distribution, in which the grid electrode has an aperture ratio distribution, and in which a region of the source-side electron beam in which a current density is largest is aligned with a region of the grid electrode in which an aperture ratio is smallest.

Further, according to one embodiment of the present invention, there is provided an X-ray generation device, including: the X-ray generation tube of one embodiment of the present invention; a tube voltage circuit to be electrically connected to each of the target and the electron source, so as to output a tube voltage to be applied between the target and the electron source; and a grid potential circuit for defining a voltage between the grid electrode and the target.

Further, according to one embodiment of the present invention, there is provided an X-ray imaging system, including: the X-ray generation device of one embodiment of the present invention; and an X-ray detector for detecting an X-ray which is emitted from the X-ray generation device and passes through an object.

Further features of the present invention will become apparent from the following description of exemplary embodiments with reference to the attached drawings.

BRIEF DESCRIPTION OF THE DRAWINGS

FIGS. 2A and 2B are characteristic diagrams respectively showing a current density distribution of an electron beam on a target side, in which FIG. 2A is a characteristic diagram of a reference example and FIG. 2B is a characteristic diagram in the X-ray generation tube of the embodiment of the present invention.

DESCRIPTION OF THE EMBODIMENTS

Embodiments of the present invention are described with reference to the drawings.

Figure 5B:
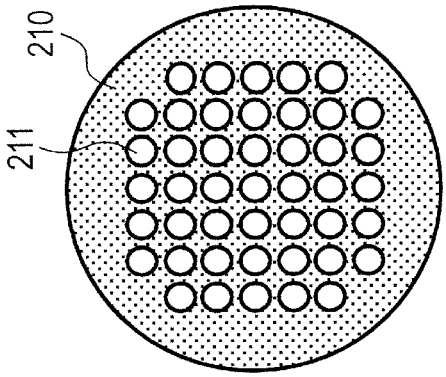
FIG. 5B PRIOR ART
FIG. 5B is a diagram illustrating a layout of electron passage apertures of a grid electrode of FIG. 5A.
Figure 5A:
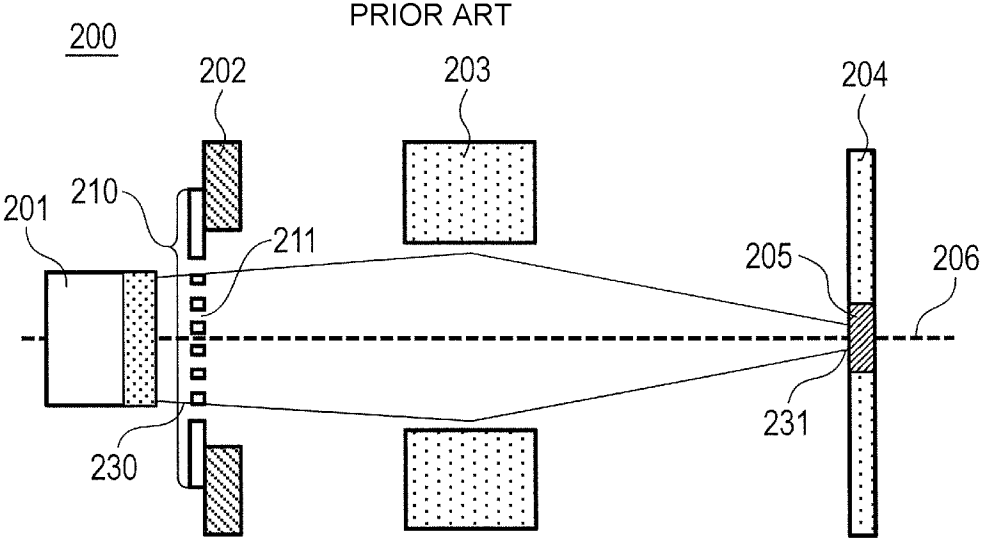
FIG. 5A PRIOR ART
FIG. 5A is a schematic diagram illustrating a related-art X-ray generation tube.

FIG. 5A illustrates a structure of a related-art X-ray generation tube as a reference example. An X-ray generation tube 200 of this reference example includes an electron source 201 having a planate electron emitting portion. Only a layout of members necessary for comparison with the embodiment of the present invention is schematically illustrated. In FIG. 5A, an insulation tube constituting a barrel portion of the X-ray generation tube of this reference example is omitted.

The electron source 201 generates a source-side electron beam 230 based on an extraction electrode 202, and a grid potential applied to a grid electrode 210 electrically connected to the extraction electrode 202. Electrons included in the generated source-side electron beam 230 are accelerated by an acceleration electric field formed by a tube voltage applied between an anode 204 and the electron source 201 so as to irradiate a target 205.

A part of the source-side electron beam 230 irradiates the grid electrode 210, and the electron beam, which passes through multiple electron passage apertures 211 of the grid electrode 210, is focused by a focusing electrode 203 and irradiates the target 205 as a target-side electron beam 231. As a result, a focal point is formed on the target 205 in an area irradiated with the target-side electron beam 231, and hence an X-ray is emitted from the focal point.

The grid electrode 210 of this reference example has the multiple electron passage apertures 211 formed in a uniform arrangement pattern as illustrated in FIG. 5B. In this specification, the "uniform arrangement" used in terms of an arrangement of the electron passage apertures means that an aperture ratio distribution of the electron passage apertures is uniform. The aperture ratio distribution is defined by at least one of an aperture area of the electron passage apertures or electron passage aperture arrangement density.

The center portions of the electrodes constituting the X-ray generation tube 200 are disposed so as to align with a center axis 206 of the electron beam as illustrated in FIG. 5A.

Figure 2A:
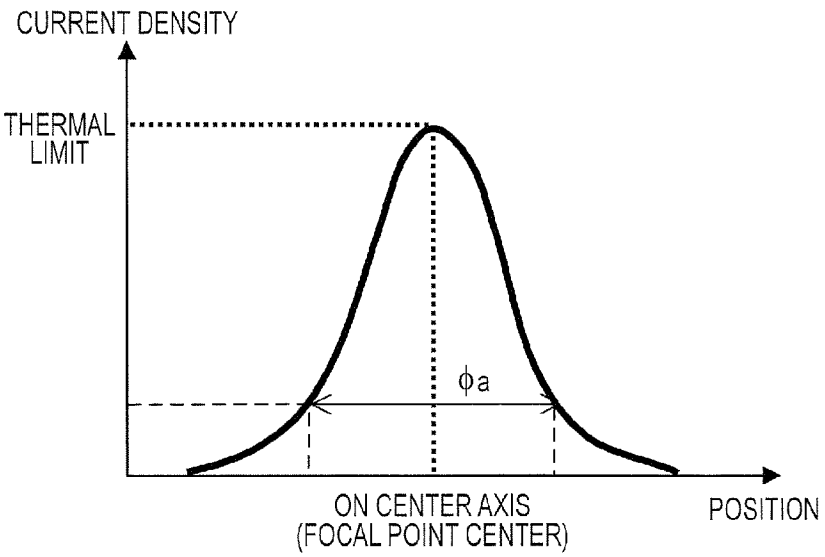

In the X-ray generation tube 200 of this reference example including the grid electrode 210 having the multiple electron passage apertures with a uniform aperture ratio, when a predetermined grid potential is applied to the grid electrode 210, a focal point corresponding to a current density distribution as Gaussian distribution illustrated in FIG. 2A is formed on the target 205. The current density distribution on the target 205 illustrated in FIG. 2A has the largest current density at the center axis 206. In this case, an electron beam center portion (hereinafter referred to as a focal point center) as an intersection of the target 205 and the center axis 206 has the highest temperature on the target 205. The fact that the source-side electron beam 230 has the current density distribution means that the electron beam has an irradiation density distribution on the target in a beam diameter direction of the source-side electron beam 230.

Therefore, in the related-art X-ray generation tube 200, it is necessary to set a current upper limit of the electron beam irradiating the target 205 within a range that does not reach a heat resistance limit at the focal point center. As a method of enhancing the current upper limit of the electron beam irradiating the target 205, there are a method of improving heat resistance and heat dissipation of the anode 204 and the target 205, a method of reducing current density at the focal point center on the target 205, and the like.

In the method of reducing the current density at the focal point center, because a thermal load at the focal point center is reduced, it is possible to enhance the upper limit of input energy higher than the conventional value. As one of the methods for the reduction, there is a method of increasing a focal point diameter. However, if the focal point diameter is increased, an imaging resolution is deteriorated.

Therefore, it is an important point for obtaining higher output power of the X-ray to reduce the current density at the focal point center on the target 205 without increasing the focal point diameter, so as to increase the upper limit of the energy input to the target 205.

For instance, the method described in Japanese Examined Utility Model Application Publication No. H04-3384 has a limitation in a shape of the electron emitting portion, a limitation of generation of a current density distribution in the electron beam, and the like.

Therefore, it has been desired to provide a method of reducing thermal damage to the target so as to realize higher output power also in a cold cathode, an impregnated hot cathode, and the like, which are not a filament type.

First Embodiment

Figure 1B:
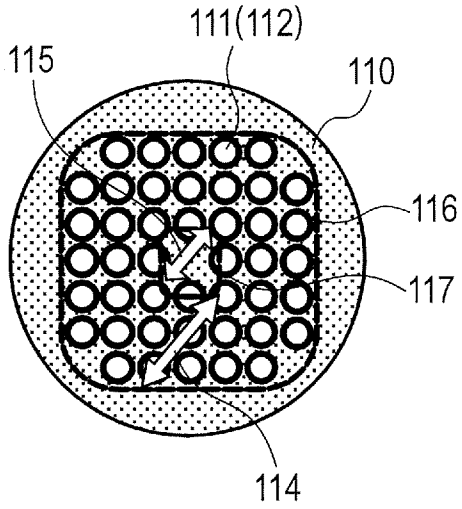
FIG. 1B is a partially enlarged view of a grid electrode according to an embodiment of the present invention.
Figure 1A:
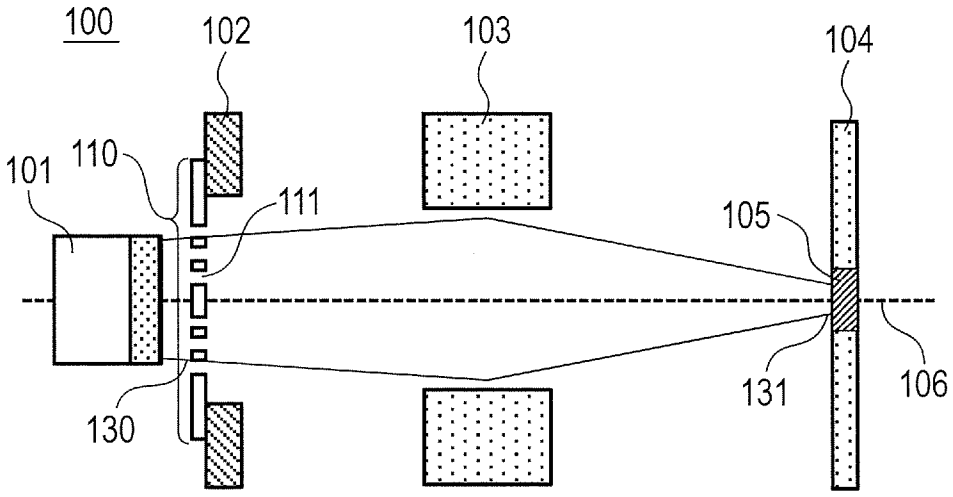
FIG. 1A is a schematic diagram illustrating an X-ray generation tube according to a first embodiment of the present invention.

FIGS. 1A and 1B are diagrams illustrating an X-ray generation tube 100 according to a first embodiment of the present invention, and are schematic diagrams illustrating a layout of components necessary for describing the present invention. In FIG. 1A, an insulation tube constituting a barrel portion of the X-ray generation tube of this embodiment is omitted. An electron source 101 and an anode 104 constituting the X-ray generation tube 100 are fixed to the insulation tube (not shown).

In addition, the X-ray generation tube of this embodiment has a transmission type structure in which the X-ray is extracted from a surface opposed to an electron incident surface of a target 105, but the present invention can be applied to a reflection type X-ray generation tube.

In the grid electrode 210 of the X-ray generation tube 200 of the reference example described above, the electron passage apertures 211 are uniformly arranged as illustrated in FIG. 5B. Therefore, there is no difference of the aperture ratio between the center portion including an intersection of the grid electrode 210 and the center axis 206 of the electron beam and its peripheral part.

In contrast, a grid electrode 110 of this embodiment has no electron passage aperture 111 at the center portion including an intersection of the grid electrode 110 and a center axis 106 of a source-side electron beam 130. In other words, the grid electrode 110 has a structure having an aperture ratio distribution in which the center portion including the intersection of the grid electrode 110 and the center axis 106 of the source-side electron beam 130 has a smaller aperture ratio than its peripheral part.

The grid electrode 110 can be divided into, based on the aperture ratio distribution, an outer region 114 provided between an outer region outer periphery 116 and an inner region outer periphery 117, and an inner region 115 surrounded by the inner region outer periphery 117. The center portion including the intersection of the grid electrode 110 and the center axis 106 of the source-side electron beam 130 corresponds to the inner region 115 surrounded by the inner region outer periphery 117 of the grid electrode 110.

The source-side electron beam 130 emitted from the electron source 101 has a current density distribution in the beam diameter direction of the electron beam. In this specification, the fact that the source-side electron beam 130 has a current density distribution means that the electron beam has an irradiation density distribution on the target in the beam diameter direction of the source-side electron beam 130. In the X-ray generation tube 100 of this embodiment, a region in which the source-side electron beam 130 has the largest current density is aligned with the center axis 106 of the electron beam.

The grid electrode 110 has multiple electron passage apertures with an aperture ratio distribution as illustrated in FIG. 1B on a surface opposed to the electron source 101. In this specification, the fact that the grid electrode 110 has the aperture ratio distribution means that the electron beam has the aperture ratio distribution in the beam diameter direction of the source-side electron beam 130. The center axis 106 at which the source-side electron beam 130 has the largest current density is positioned so as to align with the region 115 in which the grid electrode 110 has the smallest aperture ratio.

Figure 2B:
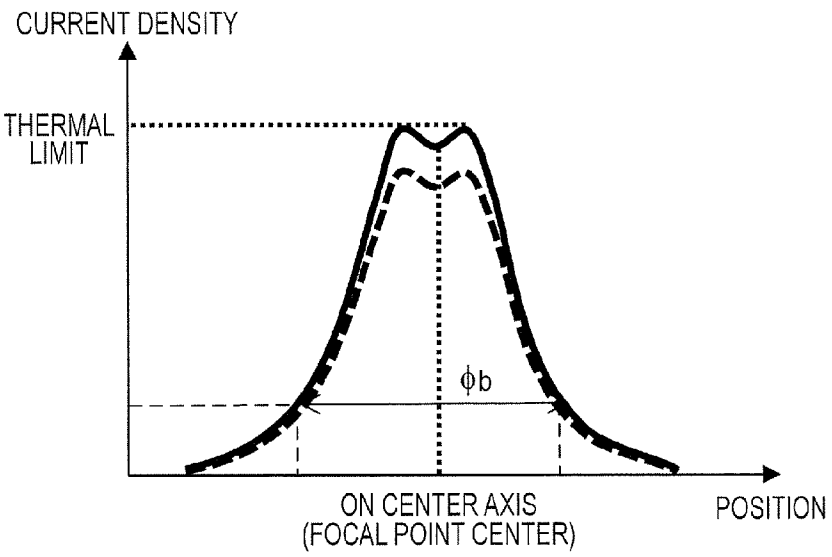

When appropriate potentials are applied to the electrodes constituting the X-ray generation tube 100 of this embodiment, there is formed a current density distribution on the target 105, which corresponds to electron irradiation density as shown in FIG. 2B by a broken line. A top hat type distribution shown in FIG. 2B corresponds to a current density distribution of a target-side electron beam 131 irradiating the target 105.

In this specification, the focal point is defined as a region having a current density of 15% or higher of the largest value in the current density distribution of the target-side electron beam 131. A focal point diameter $\phi_b$ is a width in the beam diameter direction corresponding to a region having a current density of 15% or higher of the largest value in the current density distribution of the target-side electron beam 131.

If a shape of the focal point of the target-side electron beam 131 is a circle centered at the center axis 106, the focal point diameter $\phi_b$ is matched with a diameter of the circle.

In the graphs shown in FIGS. 2A and 2B, the vertical axis represents the current density of the target-side electron beam 131, and the horizontal axis represents a position from the focal point center on the electron incident surface side of the target 105.

A conversion efficiency of irradiation current to X-ray intensity on the target 105 is substantially constant regardless of a position on the target 105. Therefore, intensity distributions of the X-rays emitted from the X-ray generation tube 200 and the X-ray generation tube 100 with respect to a position on the target are similar to the current density distributions shown in FIGS. 2A and 2B.

The X-ray intensity distribution can be measured as follows. A pinhole mask (not shown) having a predetermined aperture is disposed 10 cm ahead of an X-ray emission window, and an X-ray detector (not shown) including X-ray detection elements arranged in a two-dimensional array is disposed 40 cm further ahead of the pinhole mask. Here, with reference to the normal to the X-ray emission window, intensity detected by the X-ray detector is recorded every time when a position of the pinhole mask is changed, to thereby obtain the X-ray intensity distribution.

In this specification, a range indicating intensity of 15% or higher of the largest intensity value of the target-side electron beam 131 is defined as the focal point of the electron beam. Further, $\phi_a$ in FIG. 2A and $\phi_b$ in FIG. 2B correspond to focal point diameters of the X-ray generation tube 200 and the X-ray generation tube 100, respectively.

According to the present invention, because the grid electrode 110 has the electron passage apertures 111 with the aperture ratio distribution, the target side current density distribution is changed from a normal distribution profile to a so-called top hat type profile. As a result, the X-ray generation tube of the present invention can secure heat resistance of the target 105 in the focal point center region and can enhance output intensity of the target 105.

More specifically, the X-ray generation tube 100 of the present invention has a feature in that the grid electrode 110 has the multiple electron passage apertures 111 arranged so that the region having the largest current density of the source-side electron beam 130 is aligned with the region having the smallest aperture ratio of the grid electrode 110.

The grid electrode 110 has a smaller aperture ratio in the center portion including the intersection of the grid electrode 110 and the center axis 106 of the source-side electron beam 130 than in its periphery, and hence the energy input to the target 105 becomes smaller as well.

The electron passage apertures 111 of the grid electrode 110 only need to be arranged so that the aperture ratio in the center portion at which the grid electrode 110 crosses the center axis 106 of the source-side electron beam 130 is smaller than the aperture ratio in its peripheral part.

The aperture ratio distribution of the grid electrode 110 can be formed by at least one of a surface density distribution of the electron passage apertures 111 or an aperture area distribution of the electron passage apertures 111.

FIGS. 3A, 3B, 3C and 3D illustrate modified examples of the grid electrode 110 of the embodiment illustrated in FIGS. 1A and 1B.

Figure 3A:
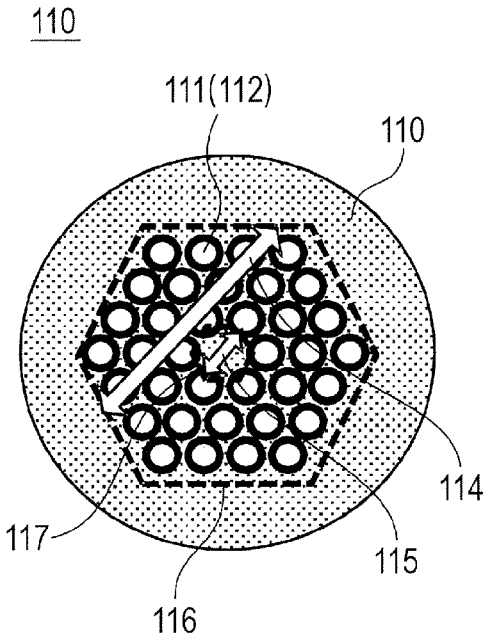
FIGS. 3A, 3B, 3C, and 3D are diagrams of grid electrodes according to other embodiments of the present invention.

The embodiment illustrated in FIG. 3A is different from the embodiment illustrated in FIG. 1B in that the outer region 114 is defined by the outer region outer periphery 116 having a regular hexagonal shape. The grid electrode 110 of this embodiment has an aperture ratio distribution defined by the surface density distribution of the electron passage apertures 111 similarly to the embodiment illustrated in FIG. 1B, and has the inner region 115 having a lower aperture ratio than the outer region 114.

Figure 3B:
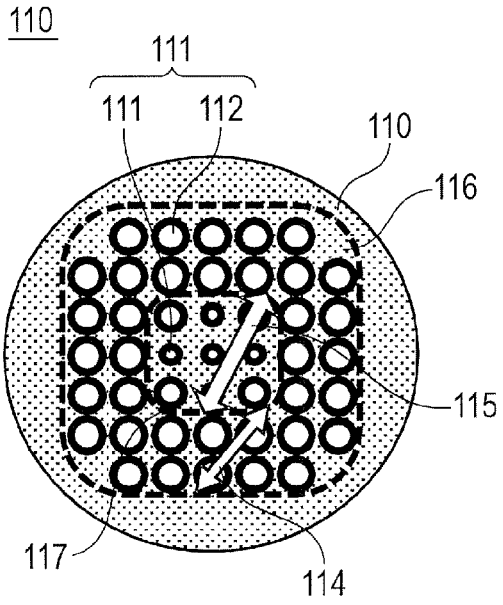

The embodiment illustrated in FIG. 3B is different from the embodiment illustrated in FIG. 1B in that the inner region 115 has electron passage apertures 113 having a smaller aperture area than electron passage apertures 112 in the outer region 114. The grid electrode 110 of this embodiment has an aperture ratio distribution defined by the aperture area distribution of the electron passage apertures 111, and has the inner region 115 having a lower aperture ratio than the outer region 114.

Further, the grid 110 of this embodiment is different from the embodiment illustrated in FIG. 1B also in that the outer region 114 is provided between the outer region outer periphery 116 and the inner region outer periphery 117 each having a substantially regular square shape.

Figure 3C:
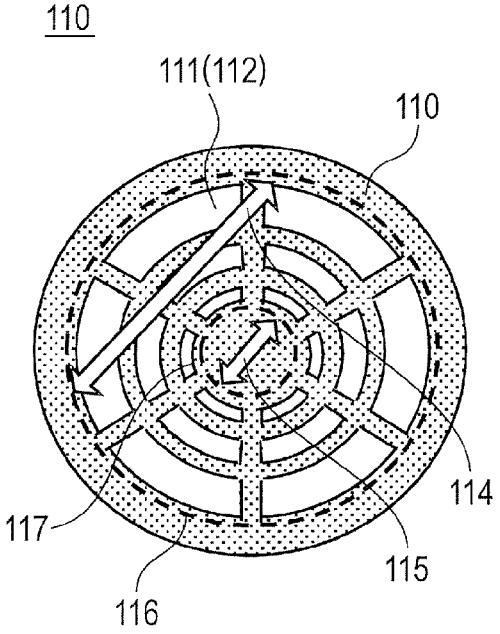
Figure 3D:
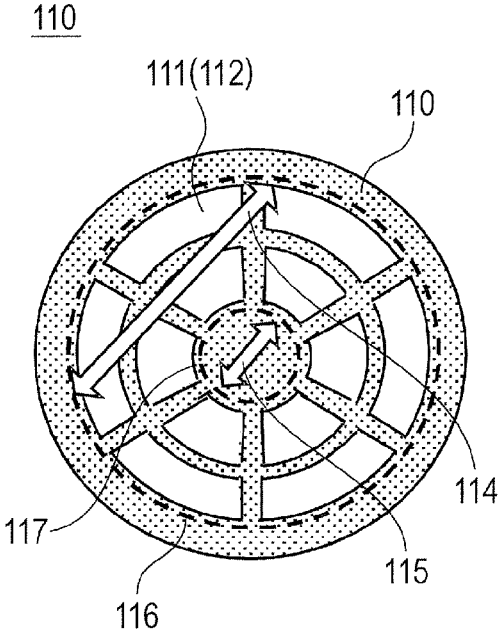

Each of the embodiments illustrated in FIGS. 3C and 3D is different from the embodiment illustrated in FIG. 1B in that the inner region 115 has an aperture ratio distribution defined by the surface density and aperture area distribution of the electron passage apertures 111 with respect to the outer region 114 in a circumferential direction and in a diameter direction of the grid 110.

The grid electrode 110 of each of the embodiments illustrated in FIGS. 3C and 3D, in which the aperture ratio distribution is formed based on the surface density and aperture area distribution of the electron passage apertures 111, is preferred from the viewpoint of controllability of beam formation because continuous aperture ratio distribution can be formed.

As the electron source 101, there is used an electron source whose electron emission amount can be controlled from the outside of the X-ray generation tube 100. An electron source that can be used for the electron source 101 is selected from the group consisting of hot cathodes of a metal filament type, an oxide filament type, and an impregnated type, and cold cathodes of a carbon nanotube type, a spindt type, and an MIM type.

The embodiment of using the impregnated hot cathode for the electron source 101 is preferred from the viewpoint of symmetry or uniformity in an electron emission surface having a predetermined area.

An extraction electrode 102 is an intermediate electrode disposed for forming an electric field in front of the electron emission source so as to control an electron emission amount from the electron source 101. The extraction electrode 102 of this embodiment is electrically connected to the grid electrode 110. The grid electrode 110 is an intermediate electrode disposed in front of the electron emission source 101 so as to form a beam profile of the source-side electron beam emitted from the electron source 101. It is not necessary that the grid electrode 110 and the extraction electrode 102 have the same potential, and the grid electrode 110 and the extraction electrode 102 may be connected to different voltage sources, respectively.

The grid electrode 110 may be disposed at any position between the electron source 101 and the target 105, but the grid electrode 110 is preferred to be disposed in a vicinity of the extraction electrode 102 considering heat generation by the irradiating electrons. In the present invention, the grid electrode having the multiple electron passage apertures with the aperture ratio distribution may be disposed as a focusing lens electrode.

The target 105 included in the X-ray generation tube 100 illustrated in FIG. 1A is a transmission type target.

The transmission type target employs a self-supported thin film structure such as gold foil, or a lamination structure in which a target layer is disposed on the surface irradiated with the target-side electron beam 131, and the target layer is supported by a transmissive substrate made of a transmissive material. The transmission type target having the lamination structure includes the target layer disposed on the side of the transmissive substrate opposed to the grid electrode.

The transmissive substrate of the transmission type target having the lamination structure is made of a light element having a smaller atomic number at least than a target metal contained in the target layer. For the transmissive substrate, beryllium, silicon carbide, diamond, or the like is used.

The transmissive substrate made of diamond (hereinafter referred to as a diamond substrate) is particularly preferred as the transmissive substrate of the transmission type target for its physical properties such as a high X-ray transmittance (atomic number of 6 and low specific gravity), a high thermal conductivity (1,600 W/(mK)), and a high heat resistance (decomposition temperature of 1,200° C. or higher).

For the diamond substrate, there is used single crystal diamond obtained by a high temperature high pressure synthetic method or the like, or polycrystal diamond obtained by a sintering method, a chemical vapor deposition method, or the like with use of microcrystal diamond as raw material.

An outer shape of the transmissive substrate is a flat plate having a surface and an opposed surface. For instance, a rectangular parallelepiped shape or a disc shape is adopted. As to a disc transmissive substrate, by setting the diameter to 2 mm or more to 10 mm or less, it is possible to dispose a target layer on which a necessary focal point diameter can be formed.

By setting the thickness of the diamond substrate to 0.5 mm or more to 2 mm or less, it is possible to secure radiation transmittance. If the diamond substrate having a rectangular parallelepiped shape is used, the above-mentioned range of the diameter may be read as a range of a short side length and a long side length of a surface of the rectangular parallelepiped.

The target layer contains a metal element having a high atomic number, a high melting point, and a high specific gravity, and contains at least a metal selected from, for example, the group consisting of tantalum, tungsten, molybdenum, silver, gold, and rhenium. From the viewpoint of compatibility with the transmissive substrate, it is more preferred that the target layer contain at least one kind of a metal selected from the group consisting of tantalum, molybdenum, and tungsten in which the standard free energy of formation of the carbide thereof becomes negative. In addition, the target layer may be formed of a pure metal having a single composition or an alloy composition, or may be formed of a metal compound such as a carbide, nitride, or oxynitride of the metal.

The thickness of the target layer is selected from the range of 1 μm or more to 12 μm or less. A lower limit and an upper limit of the thickness of the target layer are determined based on the viewpoints of securing the X-ray output intensity and reducing an interface stress, respectively. It is more preferred that the thickness be set within a range of 3 μm or more to 9 μm or less.

For the purpose of constituting a part of the anode 104 of the X-ray generation tube 100, an anode member, a brazing filler metal, and a conductive electrode (not shown) are electrically connected to the target 105. The conductive electrode is a conductive member disposed as necessary for securing electric connection with the anode member. For the conductive electrode, a metal such as tin, silver, or copper, a metal oxide, or the like is used.

The brazing filler metal has a function of supporting the target 105 with respect to the anode member as well as a function of electrically connecting the target layer and the anode member to each other. The brazing filler metal is an alloy containing gold, silver, copper, tin, and the like. The composition of the alloy is appropriately selected in accordance with the member to be bonded so that adhesiveness between the different types of materials such as the transmissive substrate, the conductive electrode, and the anode member can be secured.

Figure 4:
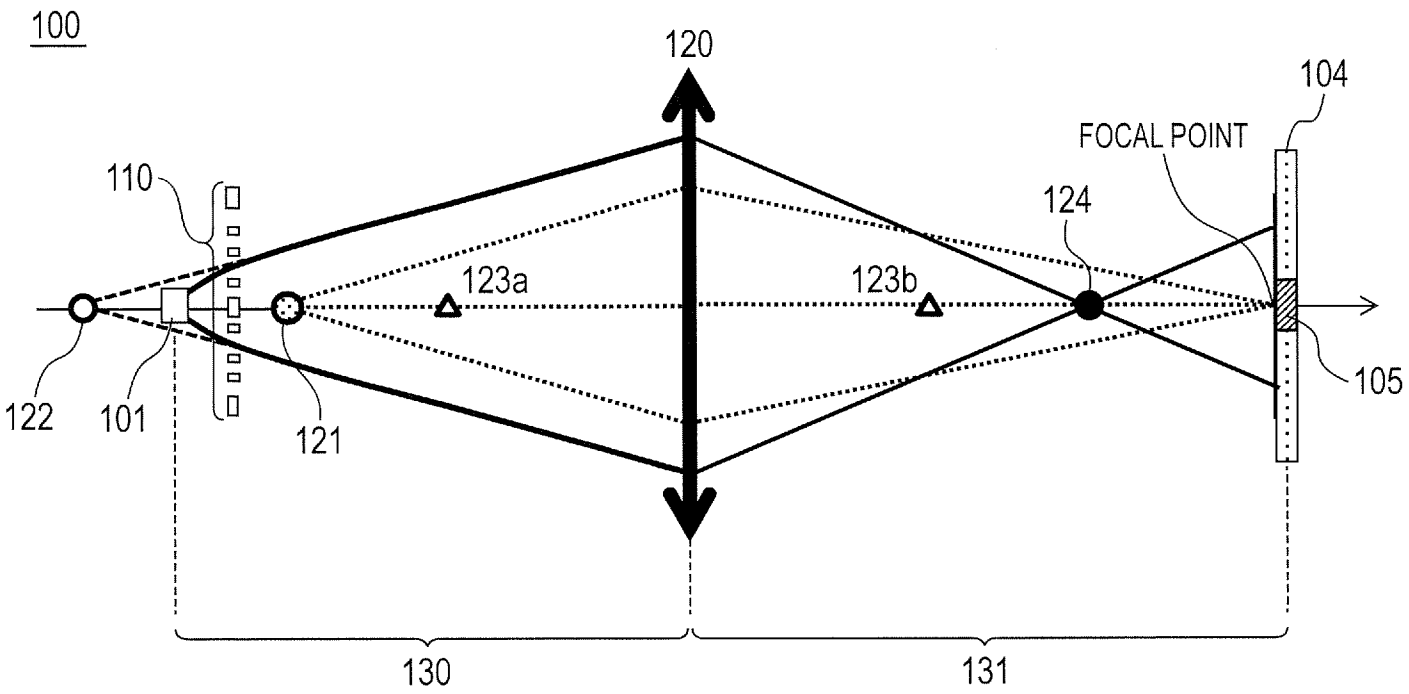
FIG. 4 is a conceptual diagram illustrating an electron optical system of the X-ray generation tube according to the embodiment of the present invention.

Next, in view of suppressing thermal damage at the focal point center of the target 105, a more preferred layout of the grid electrode 110 is described with reference to FIG. 4. FIG. 4 schematically illustrates an embodiment in which the electron beam is focused in a path from the electron source 101 to the target 105.

The X-ray generation tube 100 can adjust the focal point diameter of the electron beam emitted from the electron source 101 by a focusing lens 120 disposed between the grid electrode 110 and the target 105. The focusing lens 120 of FIG. 4 may be constituted of one focusing lens electrode, or may be constituted of multiple electrodes.

FIG. 4 illustrates a main part of the X-ray generation tube 100 forming an electron optical system, which has a crossover 124 at which the beam diameter of the target-side electron beam 131 becomes smallest. FIG. 4 illustrates multiple electronic optical virtual points, which are determined uniquely by the focusing lens 120 and its electrostatic parameters. This embodiment is different from the embodiment illustrated in FIGS. 1A and 1B at least in having the crossover 124.

Further, the electrostatic parameters of the focusing lens 120 include positions, shapes, and potentials of electrodes constituting the focusing lens 120. The shape of the electrode of the focusing lens 120 includes a shape of the electron passage aperture, and a thickness of the electrode.

The focusing lens 120 has a lens focal point at each of the front and the rear of the focusing lens 120, which corresponds to an image formation point of an object virtually disposed at infinity. In this specification, a lens focal point positioned on the electron source 101 side is referred to as a rear lens focal point 123*a*, and a lens focal point positioned on the target 105 side is referred to as a front lens focal point 123*b*.

A point conjugate to the crossover 124 with respect to the focusing lens 120 is uniquely defined on the electron source 101 side. This point conjugate to the crossover 124 is referred to as a crossover conjugate point 122. In the same manner, a point conjugate to the focal point center on the target 105 with respect to the focusing lens 120 is uniquely defined on the electron source 101 side. This point conjugate to the focal point center is referred to as a focus center conjugate point 121. The crossover conjugate point 122 corresponds to a virtually indicated cathode position and is generally called a virtual cathode.

By appropriately setting the electrostatic parameters of the focusing lens 120, it is possible to form the crossover 124 at which the beam diameter of the target-side electron beam 131 becomes smallest between the front lens focal point 123*b* and the target 105 as illustrated in FIG. 4.

In this embodiment, concerning a distance from the focusing lens 120, the crossover conjugate point 122 is farther than the focus center conjugate point 121. In addition, the grid electrode 110 is disposed between the crossover conjugate point 122 and the focus center conjugate point 121.

It is preferred to dispose the grid electrode 110 having the aperture ratio distribution close to the position of the focus center conjugate point 121. The reason is because, with this layout, an aperture shape of the grid electrode 110 projected to the target 105 can be formed with high reproducibility, and hence the current density at the focal point center on the target 105 is reduced.

Therefore, it is more preferred to dispose the grid electrode 110 having the aperture ratio distribution so as to align with the position of the focus center conjugate point 121 in order to reduce the current density at the focal point center on the target 105.

Further, the virtual points such as the crossover 124, the crossover conjugate point 122, and the focus center conjugate point 121 illustrated in FIG. 4 can be identified by calculation of electrostatic field in which dielectric constants, electrode potentials, sizes, and a layout relationship of members constituting the X-ray generation tube 100 are modeled.

Second Embodiment

Figure 6:
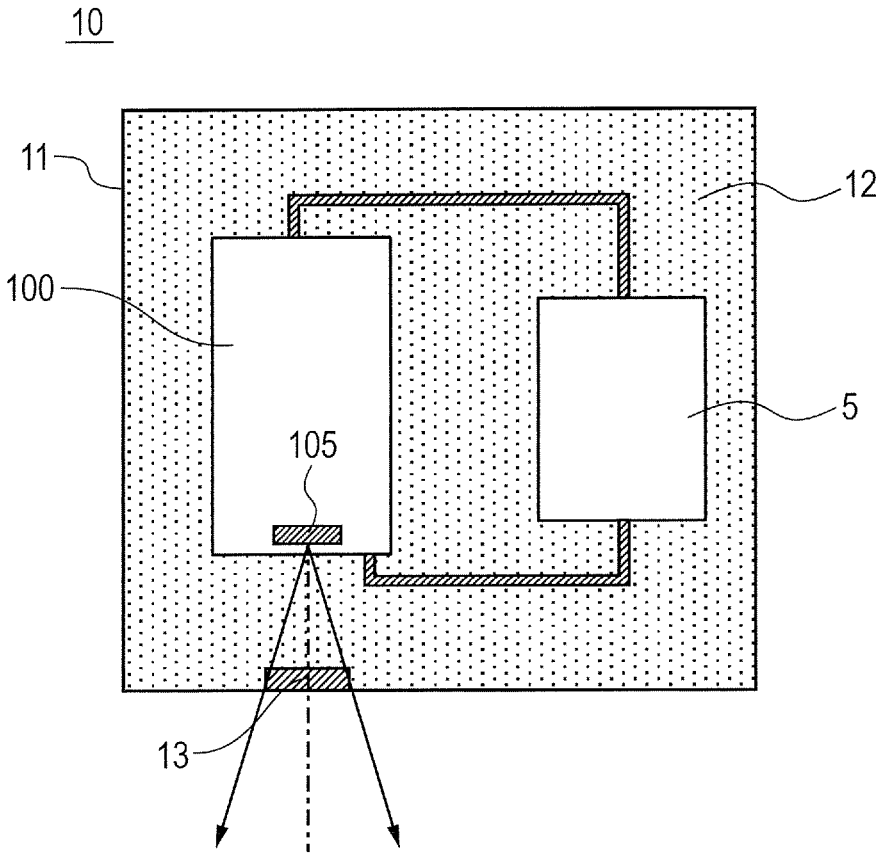
FIG. 6 is a diagram illustrating an X-ray generation device according to an embodiment of the present invention.

FIG. 6 illustrates an X-ray generation device 10 according to an embodiment of the present invention, from which an X-ray beam is extracted toward the front of an X-ray transmissive window 13. The X-ray generation device 10 of this embodiment includes, inside a housing container 11 that has the X-ray transmissive window 13, the X-ray generation tube 100 as the X-ray source and a driving circuit 5 for driving the X-ray generation tube 100.

The driving circuit 5 applies a tube voltage between the electron source and the anode of the X-ray generation tube 100 to form an acceleration electric field between the target 105 and the electron emitting portion. By appropriately setting the tube voltage in accordance with a thickness of the target layer and an element type of the target metal, it is possible to select a type of radiation necessary for imaging.

It is preferred that the housing container 11 for housing the X-ray generation tube 100 and the driving circuit 5 have sufficient strength as a container and be superior in heat dissipation. As a structural material thereof, a metal material such as brass, iron, or stainless steel is used.

In this embodiment, an insulating liquid is filled in the space in the housing container 11 except for the X-ray generation tube 100 and the driving circuit 5. The insulating liquid is liquid having electric insulation and has a role of maintaining electric insulation in the housing container 11 and a role as a medium for cooling the X-ray generation tube 100. As the insulating liquid, it is preferred to use an electric insulating oil such as mineral oil, silicone oil, and perfluoro oil.

Third Embodiment

Figure 7:
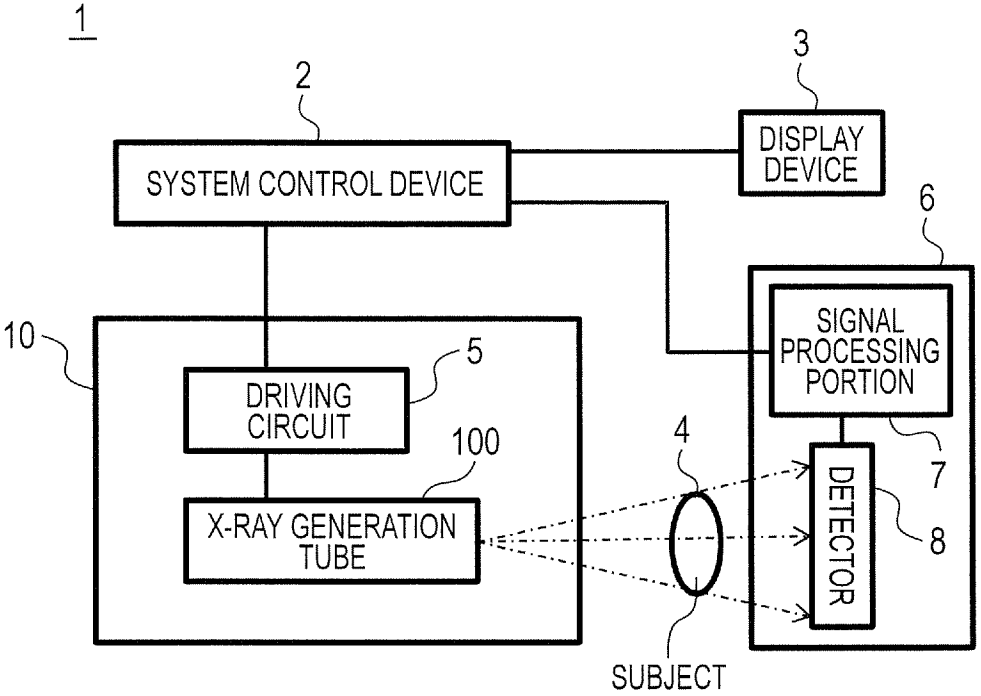
FIG. 7 is a diagram illustrating an X-ray imaging system according to an embodiment of the present invention.

Next, with reference to FIG. 7, a structural example of an X-ray imaging system 1 including the X-ray generation tube 100 of the present invention is described.

A system control device 2 integrally controls the X-ray generation device 10 and a radiation detection device 6 for detecting an X-ray. A driving circuit 5 outputs various control signals to the X-ray generation tube 100 under control by the system control device 2. In this embodiment, the driving circuit 5 is housed together with the X-ray generation tube 100 in the housing container for housing the X-ray generation device 10, but may be disposed outside the housing container. The control signal output by the driving circuit 5 controls an emission state of the X-ray beam to be emitted from the X-ray generation device 10.

The X-ray beam emitted from the X-ray generation device 10 is radiated to the outside of the X-ray generation device 10 after the radiation range thereof is adjusted by a collimator unit (not shown) having a movable stop, is caused to pass through an object 4, and is detected by a detector 8. The detector 8 converts the detected X-ray into an image signal and outputs the image signal to a signal processing portion 7.

Under control by the system control device 2, the signal processing portion 7 performs predetermined signal processing on the image signal and outputs the processed image signal to the system control device 2.

Based on the processed image signal, the system control device 2 outputs to a display device 3 a display signal for controlling the display device 3 to display the image.

The display device 3 displays on a screen an image based on the display signal as a taken image of the object 4.

The X-ray imaging system 1 can be used for a nondestructive inspection of an industrial product, or a pathological diagnosis of a human body or an animal.

In the following, structures, actions, and effects of the present invention are described more specifically with reference to examples.

Example 1

The X-ray generation tube 100 of Example 1 is described with reference to FIG. 1A. Each component has a shape symmetric with respect to the center axis 106 except for the electron passage apertures 111 of the grid electrode 110. A generally-used flat surface impregnated type cathode having a diameter of 2 mm was used for the cathode 101, and the grid electrode 110 having a thickness of 75 μm as illustrated in FIG. 1B was disposed at a position apart from the cathode 101 by 0.8 mm.

The electron passage apertures 111 of the grid electrode 110 each have a diameter of 300 μm and are arranged in a lattice pattern at a pitch of 350 μm, but there is no aperture at the center portion positioned on the center axis 106.

The extraction electrode 102 was disposed on the rear side of the surface of the grid electrode 110 opposed to the electron source 101 and was electrically connected to the grid electrode 110. The extraction electrode has an aperture having a diameter of 5 mm and a thickness of 3 mm in the direction of the center axis 106 of the X-ray. Molybdenum was used for the grid electrode 110 and the extraction electrode 102 considering heat resistance.

A focusing electrode 103 is disposed at a position apart from the extraction electrode 102 by 4 mm, and has an aperture of a thickness of 5 mm and a diameter of 10 mm. Stainless steel was used as material of the focusing electrode 103.

The anode 104 was disposed at a position apart from the focusing electrode 103 by 40 mm. In addition, because high energy flows in, diamond was disposed on the center axis 106 considering heat dissipation and X-ray transmittance, and copper was used around the diamond. Further, on the diamond, a film made of tungsten having a thickness of 5 μm was formed as the target 105. In this way, it is possible to constitute the transmission type target in which the X-ray generated from the target 105 can be extracted to the outside through the diamond disposed just below the target 105.

In the X-ray generation tube 100 configured as described above, a voltage of 0 V was applied to the electron source 101, a voltage of 200 V was applied to the extraction electrode 102 and the grid electrode 110, a voltage of 2,000 V was applied to the focusing electrode 103, and a voltage of 75 kV was applied to the anode 104 and the target 105. Then, it was confirmed that the target-side current density distribution profile of the focal point was formed to be recessed a little at the center portion as shown in FIG. 2B, that is, the current density at the focal point center was able to be suppressed. Therefore, a voltage of the extraction electrode was increased so as to increase the current up to a thermal limit of the target 105. As a result, it was possible to input energy up to the maximum of 1.7 kW.

As Comparative Example, there was manufactured the X-ray generation tube 200 including the grid electrode 210 having the electron passage apertures 211 each having a diameter of 300 μm and arranged uniformly in a lattice pattern at a pitch of 350 μm.

The X-ray generation tube 200 of Comparative Example had X-ray intensity in a Gaussian distribution as shown in FIG. 2A. The maximum value of the energy amount input to the target 205 in the X-ray generation tube 200 of Comparative Example was 1.5 kW.

As understood from the above, the X-ray generation tube 100 of Example 1 was able to obtain higher output power of the X-ray than the X-ray generation tube 200 of Comparative Example by approximately 13%.

Example 2

As the grid electrode 110, a grid electrode similar to that of Example 1 except for the electron passage apertures 111 arranged in a honeycomb pattern as illustrated in FIG. 3A was prepared, and further the X-ray generation tube was manufactured similarly to Example 1 so as to perform the test. As a result, in this example as well, the X-ray intensity distribution as shown in FIG. 2B was obtained, and the energy input up to 1.7 kW was able to be performed.

Example 3

As the grid electrode 110, the grid electrode 110 as illustrated in FIG. 3B was manufactured, in which the electron passage apertures 111 are disposed at the same positions as those of FIG. 5B, but a diameter of an aperture near the center portion is different. This grid electrode 110 is the same as that of FIG. 5B except that a center aperture and four apertures adjacent to the center aperture in the up and down direction and in the right and left direction each have a diameter of 100 μm, and four apertures diagonally adjacent to the center aperture each have a diameter of 200 μm. This grid electrode 110 was prepared, and the X-ray generation tube was manufactured similarly to Example 1 so as to perform the test. As a result, in this example as well, the energy input up to 1.7 kW was able to be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-043842, filed Mar. 6, 2013, and No. 2014-029252, filed Feb. 19, 2014 which are hereby incorporated by reference herein in their entirety.

What is claimed is:

1. An X-ray generation tube comprising:

a target for generating an X-ray through irradiation with an electron beam;

an electron source provided opposed to the target; and a grid electrode having multiple electron passage apertures, wherein the grid electrode is disposed between the target and the electron source so that a part of a source-side electron beam emitted from the electron source passes through the multiple electron passage apertures and irradiates the target, wherein the source-side electron beam shows a current density distribution, wherein the grid electrode has an aperture ratio distribution, wherein a region of the source-side electron beam, in which a current density is largest, is aligned with a region of the grid electrode, in which an aperture ratio is smallest, wherein the grid electrode causes the part of the source-side electron beam to pass through the multiple electron passage apertures so as to form a target-side electron beam on the target side of the grid electrode, and wherein a current density at a beam center of the target-side electron beam is lower than a current density at a beam center of the source-side electron beam.

2. The X-ray generation tube according to claim 1, wherein when the source-side electron beam shows the current density distribution, the electron beam shows an irradiation density distribution on the target in a beam diameter direction of the source-side electron beam.

3. The X-ray generation tube according to claim 1, wherein the grid electrode has the aperture ratio distribution in a beam diameter direction.

4. The X-ray generation tube according to claim 1, wherein the aperture ratio distribution comprises at least one of a surface density distribution of the multiple electron passage apertures or an aperture area distribution of the multiple electron passage apertures.

5. The X-ray generation tube according to claim 4, wherein the aperture ratio distribution is formed by the surface density distribution of the multiple electron passage apertures and the aperture area distribution of the multiple electron passage apertures.

6. The X-ray generation tube according to claim 1, wherein the grid electrode further comprises an extraction electrode of the electron source.

7. The X-ray generation tube according to claim 1, wherein the electron source comprises an impregnated hot cathode.

8. The X-ray generation tube according to claim 1, wherein the target comprises a transmission type target including a target layer disposed on a side opposed to the grid electrode, and a transmissive substrate for supporting the target layer.

9. The X-ray generation tube according to claim 8, wherein the transmissive substrate comprises a diamond substrate.

10. The X-ray generation tube according to claim 9, wherein the diamond substrate has a substrate thickness of 500 μm to 2 mm.

11. The X-ray generation tube according to claim 9, wherein the diamond substrate comprises one of polycrystal diamond and single crystal diamond.

12. The X-ray generation tube according to claim 8, wherein the target layer contains at least a metal selected from the group consisting of tantalum, tungsten, molybdenum, silver, gold, and rhenium.

13. The X-ray generation tube according to claim 8, wherein a thickness of the target layer is 1 μm or more to 12 μm or less.

14. An X-ray generation device comprising:

the X-ray generation tube according to claim 1;

a tube voltage circuit to be electrically connected to each of the target and the electron source, so as to output a tube voltage to be applied between the target and the electron source; and a grid potential circuit for defining a voltage between the grid electrode and the target.

15. An X-ray imaging system comprising:

the X-ray generation device according to claim 14; and an X-ray detector for detecting an X-ray which is emitted from the X-ray generation device and passes through an object.

16. An X-ray generation tube comprising:

a target for generating an X-ray through irradiation with an electron beam;

an electron source provided opposed to the target;

a grid electrode having multiple electron passage apertures; and a focusing lens electrode, wherein the grid electrode is disposed between the target and the electron source so that a part of a source-side electron beam emitted from the electron source passes through the multiple electron passage apertures and irradiates the target, wherein the source-side electron beam shows a current density distribution, wherein the grid electrode has an aperture ratio distribution, wherein a region of the source-side electron beam, in which a current density is largest, is aligned with a region of the grid electrode, in which an aperture ratio is smallest, wherein the focusing lens electrode focuses the source-side electron beam, wherein the focusing lens electrode defines, between the focusing lens electrode and the target, a crossover that is a virtual point at which a beam diameter of the target-side electron beam becomes smallest, wherein the focusing lens electrode further defines a crossover conjugate point at a position conjugate to the crossover, wherein the focusing lens electrode further defines, on the electron source side, a focus center conjugate point at a position conjugate to a focus center on the target, and wherein the grid electrode is disposed at a position from the crossover conjugate point to the focus center conjugate point.

17. The X-ray generation tube according to claim 16, wherein when the source-side electron beam shows the current density distribution, the electron beam shows an irradiation density distribution on the target in a beam diameter direction of the source-side electron beam.

18. The X-ray generation tube according to claim 16, wherein the grid electrode has the aperture ratio distribution in a beam diameter direction.

19. The X-ray generation tube according to claim 16, wherein the aperture ratio distribution comprises at least one of a surface density distribution of the multiple electron passage apertures or an aperture area distribution of the multiple electron passage apertures.

20. The X-ray generation tube according to claim 19, wherein the aperture ratio distribution is formed by the surface density distribution of the multiple electron passage apertures and the aperture area distribution of the multiple electron passage apertures.

21. The X-ray generation tube according to claim 16, wherein the grid electrode further comprises an extraction electrode of the electron source.

22. The X-ray generation tube according to claim 16, wherein the grid electrode is positioned so as to be overlapped with the focus center conjugate point.

23. The X-ray generation tube according to claim 16, wherein the electron source comprises an impregnated hot cathode.

24. An X-ray generation device comprising:

the X-ray generation tube according to claim 16;

a tube voltage circuit to be electrically connected to each of the target and the electron source, so as to output a tube voltage to be applied between the target and the electron source; and a grid potential circuit for defining a voltage between the grid electrode and the target.

25. An X-ray imaging system comprising:

the X-ray generation device according to claim 24; and an X-ray detector for detecting an X-ray which is emitted from the X-ray generation device and passes through an object.

* * * * *